United States Patent [19]

Chittick

[11] Patent Number: 4,584,947

[45] Date of Patent: Apr. 29, 1986

[54] FUEL GAS-PRODUCING PYROLYSIS REACTORS

[76] Inventor: Donald E. Chittick, Rte. 2, Box 194, Newberg, Oreg. 97132

[21] Appl. No.: 749,990

[22] Filed: Jul. 1, 1985

[51] Int. Cl.[4] ..... F23G 5/12

[52] U.S. Cl. ..... 110/229; 48/76; 48/77; 48/113; 48/196 A

[58] Field of Search ..... 110/229, 230, 231; 48/76, 77, 101, 113, 196 A

[56] References Cited

U.S. PATENT DOCUMENTS

| | | | |
|---|---|---|---|
| 2,168,652 | 8/1939 | McDonald | 48/76 |
| 4,213,404 | 7/1980 | Spaulding | 110/229 |
| 4,309,195 | 1/1982 | Rotter | 48/76 |
| 4,538,528 | 9/1985 | Faehnle | 110/229 |

*Primary Examiner*—Edward G. Favors

*Attorney, Agent, or Firm*—Chernoff, Vilhauer, McClung, Birdwell & Stenzel

[57] ABSTRACT

Novel designs of two types of down draft pyrolysis reactors are disclosed. One is a solid fuel reactor including a novel arrangement of down draft air inlet entrances, air distribution means, a consumable/replenishable catalytic bed, a heat exchanger for preheating inlet gas with the sensible heat of the exiting gas, and an infrared radiation trap below the reactor's screen grate. The other is an off gas pyrolysis reactor which includes a down draft reaction chamber with a fixed catalytic bed, a similar heat exchanger arrangement, an infrared radiation shield, an infrared radiation trap outside the gas outlet of the reaction chamber, and a unique relationship between the infrared radiation shield and the surface of the fixed catalytic bed.

17 Claims, 2 Drawing Figures

FUEL GAS-PRODUCING PYROLYSIS REACTORS

This invention relates to the production of relatively clean fuel gas from solid carbonaceous material and from the off gas of a biomass pyrolyzer, and to improved apparatus for accomplishing the same.

BACKGROUND OF THE INVENTION

Because of the ever-increasing cost of conventional energy sources such as oil, gas, coal, and electricity, there has been a corresponding rise in interest in less expensive energy alternatives. One such alternative is so-called "producer gas," a low Btu fuel gas whose oxidizable components comprise carbon monoxide, hydrogen and methane, the gas being obtainable from the partial combustion of waste carbonaceous materials such as wood chips, bark, sawdust, and other biomass sources such as ground corn cobs, lignite, peat moss, etc. However, a recurring problem in methods and apparatus for the production of such fuel gas is the generation of ash that tends to fuse into irregular-sized chunks, known as slag, the formation of which tends to block gas passageways and so reduce the efficiency of the pyrolysis of the solid waste materials. Another common problem which reduces pyrolysis efficiency is the buildup of condensates of tar and resin, resulting in blinding and otherwise restricting filters, grates, and gas passageways. Still another problem in the art is the production of an off gas from such solid waste pyrolysis that contains insufficient concentrations of combustible gases to comprise a useful fuel product. These and other problems are addressed and resolved by the pyrolysis reactors of the present invention, which are summarized and described in detail below.

SUMMARY OF THE INVENTION

There are fundamentally two aspects to the present invention: (1) the provision of a novel design for a down draft pyrolysis reactor for converting solid carbonaceous fuel to a substantially slag-free, tar-free, and high Btu-containing producer gas; and (2) the provision of a novel design for a down draft pyrolysis reactor for upgrading the off gas of a carbonaceous material or biomass pyrolyzer to a high Btu-containing producer gas. The solid fuel pyrolysis reactor includes a novel arrangement of down draft air inlet entrances, air distribution means, a consumable/replenishable catalytic bed, a heat exchanger for preheating inlet gas with the sensible heat of the exiting gas, infrared radiation shields and an infrared radiation trap below the reactor's screen grate. The off gas pyrolysis reactor includes a down draft reaction chamber with a fixed catalytic bed, a similar heat exchanger arrangement, an infrared radiation shield, an infrared radiation trap outside the gas outlet of the reaction chamber, and a unique relationship between the infrared radiation shield and the surface of the fixed catalytic bed.

DETAILED DESCRIPTION OF THE INVENTION

Figure 1:
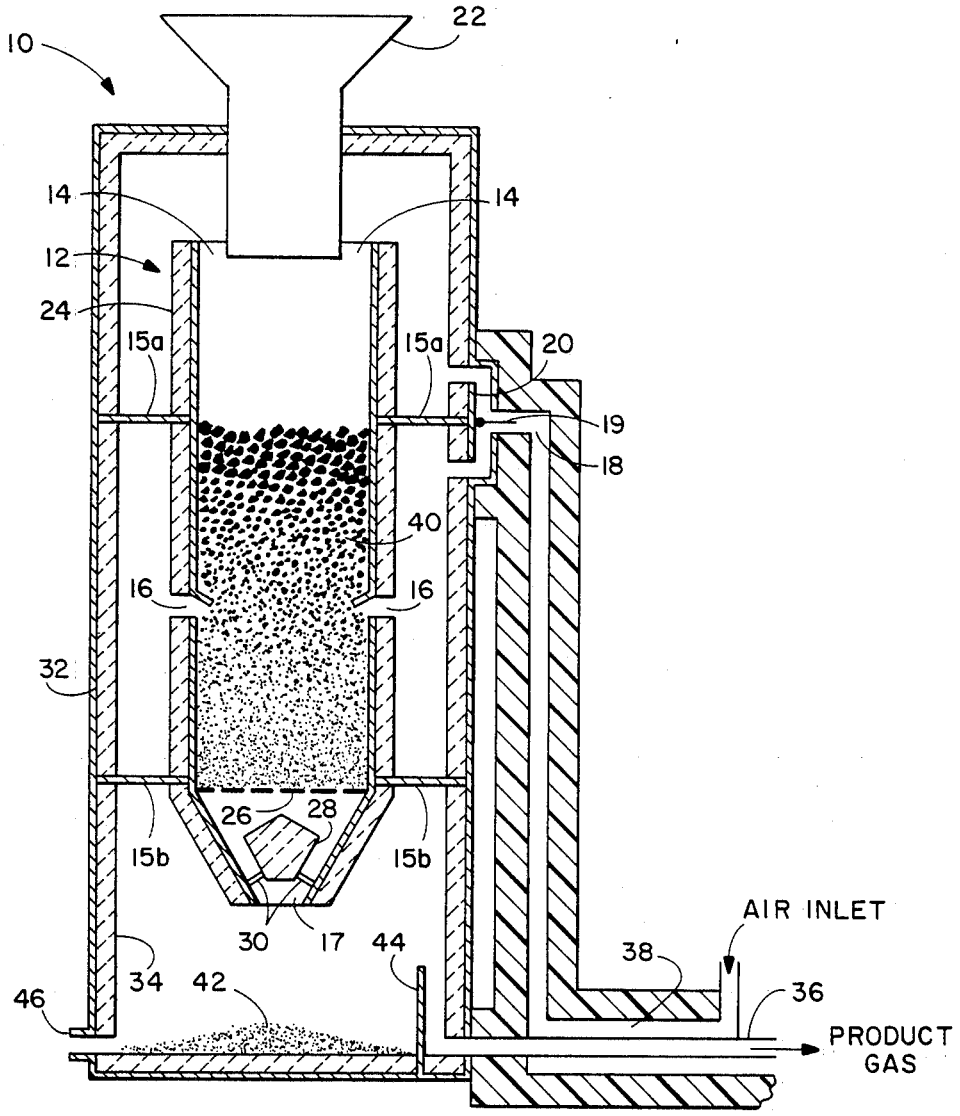
FIG. 1 is a cross-sectional schematic drawing exemplifying the solid fuel pyrolysis reactor of the present invention.

Referring to the drawings, FIG. 1 illustrates a solids pyrolysis reactor 10 comprising a down draft reaction chamber 12 having an upper air inlet entrance 14, lower air inlet entrance 16, and gas outlet 17. A screen grate 26 is at the bottom of the reaction chamber, and an infrared radiation trap 28 is below the screen grate 26, supported to the reaction chamber by supports 30. Air inlet port 18 is in communcation with both upper and lower air inlet entrances 14 and 16 by means of manifold 20 and dividers 15*a* and 15*b*. An air distribution valve 19 may optionally be utilized in the area of the air inlet port 18; here one is shown associated with manifold 20. Solid fuel feed means such as a hopper 22 is mounted atop outer jacket 32 of the pyrolysis reactor 10. The space 42 below the bottom of reaction chamber 12 and further defined by outer jacket infared shield 34 and interior flange 44 serves as an ash receptacle, an ash clean-out port 46 being provided at the side and bottom thereof. Gas exit port 36 is in communication with gas outlet 17, and having associated therewith countercurrent heat exchanger 38 which transfers heat from the exiting product gas to incoming fresh air so as to preheat the same. A charcoal bed 40 is shown generally located in the lower two-thirds of reaction chamber 12 and supported by screen grate 26.

The walls of reaction chamber 12 of the solids pyrolysis reactor 10 shownin FIG. 1 are surrounded with an infrared radiation shield 24 to minimize loss of heat through infrared radiation. A similar infrared radiation shield 34 is on the inner portions of the outer jacket 32 of the pyrolysis reactor 10.

It has been determined that, at the reaction temperatures of the pyrolysis of solid carbonaceous fuels and the off gases of such fuels (greater than about 800° C.), the most significant deterrent to efficient pyrolysis for production of producer fuel gas is the loss of heat through infrared radiation, or radiation with a wavelength between about 0.8 and 1000 microns. When infrared radiation shields are placed in the arrangement shown and discussed herein, in combination with the other design elements disclosed, efficient pyrolysis occurs, resulting in the production of substantially char-free, tar-free, and high thermal content fuel gas comprising carbon monoxide, hydrogen, and methane.

A significant reason for the slag-free and tar-free nature of the fuel gas produced with the type of pyrolysis reactor exemplified in FIG. 1 is the inclusion of an infrared radiation trap 28 below the screen grate 26. The infrared trap 28 captures and re-radiates infrared heat to the area of the screen grate 26, maintaining the temperature in that area sufficiently high so as to prevent slag formation at the bottom of the reaction chamber and also to prevent condensation of tars and resin. Because the screen grate 26 remains slag-free and condensate-free, the circulation of air through the reaction chamber 12 remains relatively constant and at a relatively uniform temperature.

Another reason for the slag-free and tar-free operation of solids pyrolysis reactor 10 is the inclusion of infrared shields 24 and 34. Infrared shield 24, which surrounds reaction chamber 12, acts to contain and re-radiate infrafrd radiation emmissions from reaction chamber 12, which are particularly high at the temperature of operation (e.g., 800° to 1000° C.). Infrared shield 34 on the inside of outer jacket wall 32 further contains infrared radiation within the system, allowing for a near-perfect "black body" state with respect to minimizing heat lost through infrared radiation.

Infrared radiation shields 24 and 34 may be made of any suitable refractory material capable of reflecting the wavelengths of infrared radiation. Preferred materials are blankets of ceramic fibers and the oxides of aluminum, magnesium, titanium, and zirconium. Infrared radiation trap 28 may be made of similar materials; however, a preferred construction is a refractory metal shell such as Inconel (a high nickel content stainless steel) with refractory material such as zirconia inside the shell.

The outer jacket wall 32 is preferably constructed of corrosion-resistant mild steel, while reaction chamber 12 should be of a material capable of withstanding the oxidation that occurs at the high reaction temperatures therein, such as Inconel.

Another unique design feature of the solids pyrolysis reactor 10 exemplified in FIG. 1 is the provision of a secondary air inlet 16 in the lower portion of reaction chamber 12, the secondary air inlet 16 being segregated from the upper portion of the reaction chamber by manifold 20 and upper dividers 15*a*, and further being segregated from the gas outlet 17 of the reaction chamber by means of lower dividers 15*b*. Such a secondary air inlet greatly enhances the downward flow of air within the reaction chamber 12 and through the charcoal bed 40, creating a venturi effect and consuming charcoal in the lower section of the reactor so as to provide room for a fresh supply of charcoal.

In operation of the solids pyrolysis reactor 10 exemplified in FIG. 1, solid fuel particles such as pelletized biomass, wood chips, chopped corn cobs, nut shells, etc., pass downward from fuel hopper 22 to reaction chamber 12 where they immediately encounter hot oxidizing gas in the upper portion of the reaction chamber, the hot oxidizing gas comprising preheated atmospheric air entering via air inlet port 18 and upper air inlet entrance 14. Combustion may be initiated either by the provision of hot charcoal or by igniting the top surface of the charcoal bed while drawing oxidizing air therethrough. Most raw fuel pyrolysis occurs in the uper portion of reaction chamber 12, the fuel particles being pyrolyzed by the hot air and high temperatures (>800° C.) resulting from partial oxidation of combustibles. Volatiles driven off from the fuel particles are converted to a mixture of low molecular weight fuel gases, carbon monoxide and hydrogen being the major constituents. Resulting charcoal falls downwardly and adds to charcoal bed 40, where pyrolysis and volatization continue. Charcoal in the charcoal bed 40 in the form of carbon reacts with water, carbon dioxide and oxygen to form carbon monoxide and hydrogen, and so is eventually gasified as well, the gasification being particularly enhanced in the lower portion of the reactor between lower air inlet entrance 16 and screen grate 26 due to the combined effects of the fresh charge of oxidizing air entering lower air inlet 16 and the high degree of heat retention in the area of screen grate 26 due to the capturing and re-radiation of infrared radiation from infrared trap 28. It should be noted that in the arrangement of elements comprising the solids pyrolysis reactor 10 exemplified in FIG. 1, charcoal bed 40 has the dual functions of a volatizable fuel source and a catalytic bed, the catalytic bed assisting in the cracking of higher molecular weight organic compounds found in the raw fuel source. Thus, the volatizable fuel source and the catalytic bed of the pryolysis reactor (charcoal bed 40), is maintained at a relatively constant volume and yet is in a constant state of flux, being steadily consumed and at the same time regenerated by the addition of new charcoal to its upper portions. As the fuel particles are consumed, any mineral content exits the reactor as small particulates or fused small droplets comprising ash which drops through screen grate 28 to ash receptacle 42 to be periodically removed through ash clean-out port 46.

Fuel gas resulting from pyrolysis and volatilization of raw fuel exits the reactor via gas outlet 17, through the plenum formed by interior flange 44 and infrared-shielded outer jacket wall 32 and thence through gas exit port 36. Gas exit port 36 is an integral part of countercurrent heat exchanger 38, which is designed so as to pass sensible heat from the produce gas in an amount sufficient to preheat entering atmospheric air so that such atmospheric air can initiate pyrolysis of fuel particles entering the upper region of pyrolysis reactor 12. As noted previously, if desired, the volume of preheated air entering the reaction chamber through upper and lower air inlet entrances 14 and 16, respectively, may be proportioned by air distribution valve 19.

Figure 2:
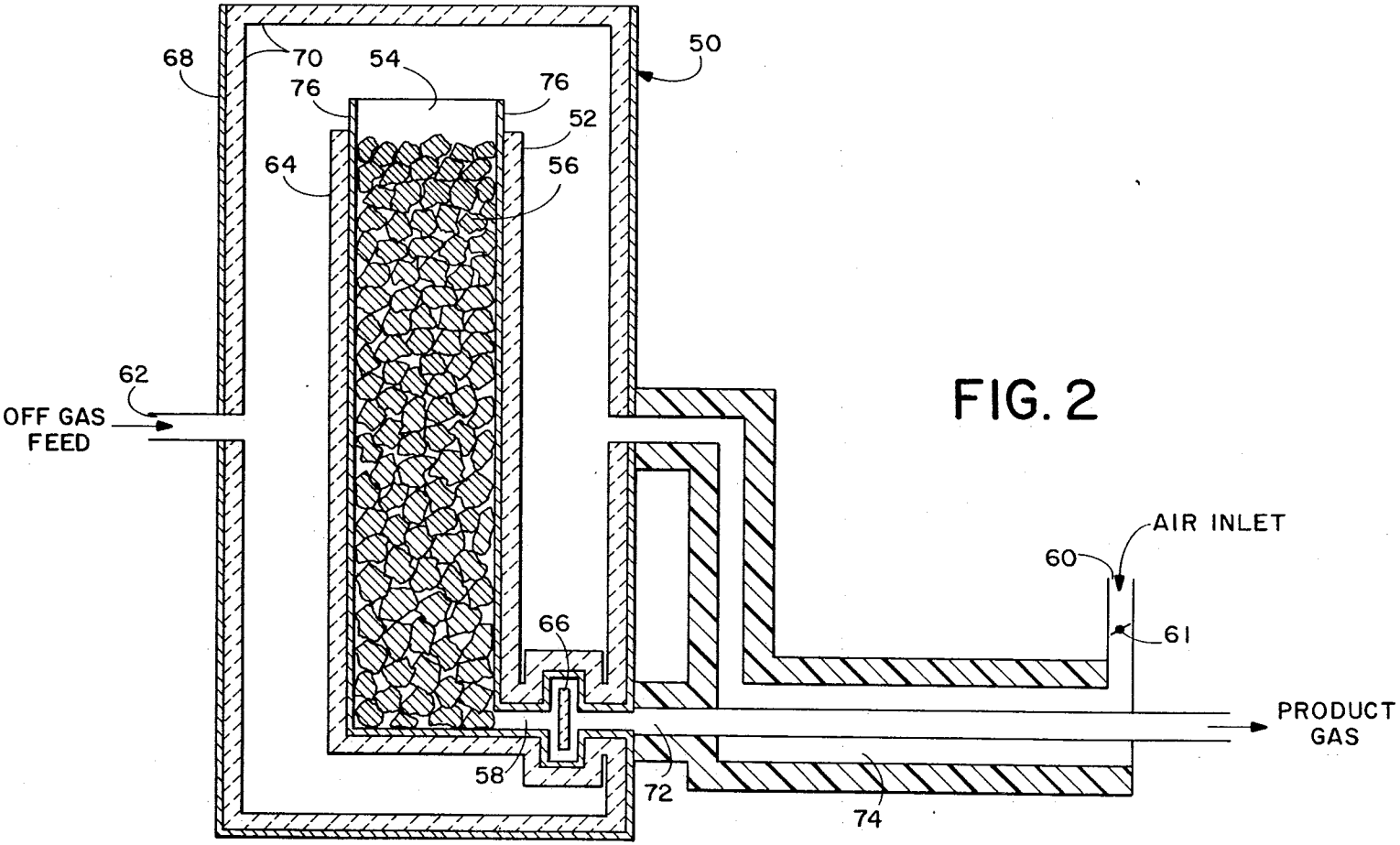
FIG. 2 is a cross-sectional schematic drawing exemplifying the off gas pyrolysis reactor of the present invention.

FIG. 2 illustrates a pyrolysis reactor 50 designed principally to upgrade the thermal content of off gas from a carbonaceous materials oxidizer such as a conventional updraft biomass gasifier. The reactor comprises a down draft reaction chamber 52 having an air inlet entrance 54 at the top thereof, a fixed, nonconsumable catalytic bed 56, and a gas outlet 58 at the bottom thereof. Outside the gas outlet 58 is an infrared radiation trap 66 (its support not being shown) and a gas exit port 72, the latter being in communication with heat exchanger 74 which utilizes sensible heat from the hot exiting gas to preheat incoming oxidizing air. Incoming oxidizing air passes through air inlet port 60, optional butterfly-type valve 61, and a plenum defined by the walls of outer jacket 68 and reaction chamber 52 to the reaction chamber's air inlet entrance 54, where it mixes with the off gas feed passing through off gas feed inlet port 62. Oxidizing air and off gas feed then pass over catalytic bed 56, the resulting pyrolysis forming an upgraded producer gas that leaves the system through gas outlet 58 and gas exit port 72. An infrared radiation shield 64 substantially surrounds reaction chamber 52, reaching to a point slightly above an imaginary plane formed by the top of catalytic bed 56. On the inner side of the wall of outer jacket 68 is another infrared radiation shield 70.

The composition and function of infrared radiation shields 64 and 70 and infrared radiation trap 66 are the same as discussed in connection with the solids pyrolysis reactor illustrated in FIG. 1. Similarly, the same materials preferred for constructing the outer jacket and reaction chamber of the solids pyrolysis unit are suitable for forming the counterpart off gas pyrolysis reactor elements.

The precise composition of catalytic bed 56 will vary somewhat with the nature of the off gas fuel gas that is to be further cracked in the pyrolysis reactor exemplified in FIG. 2, but typical suitable materials are chromia and alumina. Again, although different entering combustible off gases require different temperatures for effective cracking, typical temperatures range from about 800° C. to about 1400° C. After mixing and heating, the gases enter into reaction chamber 52 where reaction is completed both by thermal effects and by contact with catalytic bed 56.

From a cold start, the off gas pyrolysis reactor is brought into operation by admitting excess air to mix with incoming combustible fuel gas. The mixture may be ignited in any suitable manner, such as an electrical spark. Following ignition, the temperature rapidly rises to that needed for cracking the fuel gas. When the cracking temperature is reached, the amount of incoming atmospheric air may be reduced by valve 61 to the minimum amount necessary to maintain the proper operating temperature.

An important design feature of the off gas pyrolysis reactor exemplified in FIG. 2 is the relationship between the top of the catalytic bed 56, the top of reaction chamber 52, and the top of infrared shield 64. It has been found that the most efficient pyrolysis occurs when the so-called "flame front," or area of most intense pyrolysis, is maintained in a fairly limited area immediately adjacent the upper surface of the catalytic bed 56. The design of the off gas pyrolysis reactor of the present invention accomplishes this by extending reaction chamber's infrared shield 64 to a point slightly above the imaginary plane formed by the upper surface of the catalytic bed, which has the effect of trapping and reflecting sufficient infrared radiation to maintain a fairly narrow band of higher temperatures across the upper surface of the catalytic bed. At the same time, due to the lack of infrared shielding, sufficient infrared radiation escapes from the region of the walls of the reaction chamber designated by the numeral 76 to allow initiation of free radical formation with fuel gas entering the top of down draft reaction chamber. Such free radical formation constitutes a significant chemical step toward a complete pyrolysis conversion of the relatively low grade fuel gas to the desired higher grade (in terms of thermal content) producer gas, most of such a complete conversion occurring in the area of the "flame front."

EXAMPLE 1

A solids pyrolysis reactor of the design illustrated in FIG. 1 having a 2-inch-thick IR shield 24 made of ceramic fiber blanket around reaction chamber 12, a 1-inch-thick IR shield 34 of ceramic fiber blanket on the inside of outer jacket 32, and an IR trap 28 made of an Inconel shell and filled with zirconia was charged and operated. Reaction chamber 12 was filled about ¾ full of ½ minus charcoal briquets to form charcoal bed 40. Gas exit port 36 was connected to the carburetor of an idling single cylinder four-cycle overhead valve internal combustion engine, the vacuum of the engine's manifold drawing air through the reaction chamber 12 via gas outlet 17, the plenum formed by interior flange 44 and outer jacket 32, and gas exit port 36. A golf-ball-sized wad of newspaper was ignited and placed on top of the charcoal bed until the top of the bed started to glow. Fuel hopper 22 was then filled with ¼ inch diameter pellets of compacted bark dust and sawdust. Upon entering reaction chamber 12, the pellets encountered hot oxidizing gas at temperatures varying between 300° C. and 800° C., depending upon the rate of air draw-through, whereby pyrolysis began. Charcoal in the lower section of reaction chamber 12, generally below lower air inlet 16, reached temperatures of between 1000° C. and 1200° C., based upon thermocouple readings. After passing through heat exchanger 38, product gas was at or near ambient temperature. The unit was continually fed fuel and operated at various rates for 6 hours, the charcoal bed 40 remaining relatively constant in volume. Gas chromatograph and gas calorimeter readings showed the product fuel gas to comprise 17.6% hydrogen, 11.0% carbon dioxide, 21.6% carbon monoxide, 2.5% methane, 1.7% water, and the remainder nitrogen with a heating value of 138 Btu/ft$^3$. After 6 hours of operation, screen grate 26 was inspected and found to be totally slag- and tar-free. Ash receptacle 42 also contained neither slag nor tar, the only ash comprising very fine mineral particles less than ⅛ inch in diameter.

EXAMPLE 2

An off gas pyrolysis unit of the construction illustrated in FIG. 2 received low-grade off gas (100–120 Btu/ft$^3$ for noncondensable portions) from a conventional updraft pyrolyzer oxidizing wood chips through off gas inlet port 62, the off gas mixing with atmospheric air in the air inlet region 54 and, upon ignition, forming a flame front appearing as a bright yellowish-white glow just off the top surface of the fixed catalytic bed 56. The fixed catalytic bed comprised ½ minus crushed chromia fire brick, filling reaction chamber 52 to a point below the top of the reaction chamber and slightly below the top of IR radiation shield 64. Reaction chamber IR radiation shield 64 comprised a 1-inch-thick ceramic fiber blanket, while outer jacket IR radiation shield 70 comprised a 2-inch-thick blanket of the same material. IR radiation trap 66 was of a similar construction to that used in Example 1. Oxidizing gas passing through air inlet 60 ranged between 300° and 850° C., while temperature in the region of the catalytic bed was maintained around 1100° C. Product gas exiting through gas exit port 72 was near ambient temperatures after passing through heat exchanger 74. Analysis of the product gas showed it to be essentially the same composition as the product gas of Example 1, while gas calorimeter readings showed it to contain about 140 Btu/ft$^3$. After 3 hours of operation, the pyrolysis reactor was dismantled and examined and all parts thereof were found to be tar-free.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A pyrolysis reactor for converting solid carbonaceous fuel to a substantially slag-free and tar-free fuel gas comprising carbon monoxide, hydrogen and methane at temperatures in excess of about 700° C. comprising:

(a) a down draft reaction chamber with walls, with two segregated down draft air inlet entrances, one of said air inlet entrances at the top of said reaction chamber and the other of said air inlet entrances in the lower portion of said reaction chamber, and with a gas outlet at the bottom of said reaction chamber;

(b) an air inlet port in communication with each of said air inlet entrances of said reaction chamber;

(c) solid fuel feed means for feeding solid fuel to said reaction chamber;

(d) an infrared radiation shield surrounding the walls of said reaction chamber;

(e) screen grate means at the bottom of said reaction chamber;

(f) an infrared radiation trap below said screen grate means;

(g) an outer jacket spaced apart from and surrounding said reaction chamber, said outer jacket having an infrared radiation shield on the inner portion thereof: and (h) a gas exit port in communication with said gas outlet of said reaction chamber, said gas exit port having associated heat exchange means for transferring heat from gas passing through said gas exit port to air passing through said air inlet port.

2. The reactor of claim 1 wherein said infrared radiation shields and said infrared radiation trap are made of a material selected from the group consisting essentially of refractory metals, ceramic fibers, alumina, magnesia, titania, and zirconia.

3. The reactor of claim 1 wherein said reaction chamber is substantially cylindrical.

4. The reactor of claim 1 including partitions between said reaction chamber and said outer jacket for segregating said two segregated down draft air inlet entrances.

5. The reactor of claim 1 including air distribution means for distributing air from said air inlet port into each of said two segregated down draft air inlet entrances.

6. The reactor of claim 5 wherein said air distribution means comprises a valve between said air inlet port and said segregated down draft air inlet entrances.

7. The reactor of claim 1, including a cleanable ash receptacle.

8. The reactor of claim 7 wherein said cleanable ash receptacle is in the bottom of said outer jacket and includes a clean out port.

9. The reactor of claim 1 wherein said solid fuel feed means comprises a hopper mounted on top of said outer jacket.

10. The reactor of claim 1, including an off gas inlet port in communication with said two segregated down draft air inlet entrances, for feeding to said reaction chamber off gas from a carbonaceous materials oxidizer.

11. The reactor of claim 1, including means for removing partially oxidized solid fuel from said reaction chamber.

12. A pyrolysis reactor for converting the off gas of a carbonaceous materials oxidizer to fuel gas comprising carbon monoxide, hydrogen and methane at temperatures from about 800° C. to about 1400° C. comprising:

(a) a down draft reaction chamber with walls, with a fixed catalytic bed inside said reaction chamber, with a down draft air inlet entrance at the top of said reaction chamber, and with a gas outlet at the bottom of said reaction chamber;

(b) an air inlet port in communication with said air inlet entrance of said reaction chamber;

(c) a carbonaceous materials oxidizer off gas inlet port in communication with said air inlet entrance of said reaction chamber;

(d) an infrared radiation shield surrounding the walls of said reaction chamber to a point slightly above the surface of said fixed catalytic bed;

(e) an infrared radiation trap outside said gas outlet of said reaction chamber;

(f) an outer jacket spaced apart from and surrounding said reaction chamber, said outer jacket having an infrared radiation shield on the inner portions thereof; and (g) a gas exit port in communication with said gas outlet of said reaction chamber, said gas exit port having associated heat exchange means for transferring heat from gas passing through said gas exit port to air passing through said air inlet port.

13. The reactor of claim 12 wherein said infrared radiation shields and said infrared radiation trap are made of a material selected from the group consisting essentially of refractory metals, ceramic fibers, alumina, magnesia, titania, and zirconia.

14. The reactor of claim 12 wherein said reaction chamber is substantially cylindrical.

15. The reactor of claim 12 wherein said fixed catalytic bed is selected from the group consisting essentially of the oxides of chromium and aluminum.

16. The reactor of claim 12 including a valve between said air inlet port and said air inlet entrance of said reaction chamber.

17. The reactor of claim 12 including a barrier between said fixed catalytic bed and said gas outlet at the bottom of said reaction chamber.

* * * * *

UNITED STATES PATENT AND TRADEMARK OFFICE

CERTIFICATE OF CORRECTION

PATENT NO. : 4,584,947

DATED : April 29, 1986

INVENTOR(S) : Donald E. Chittick

It is certified that error appears in the above-identified patent and that said Letters Patent is hereby corrected as shown below:

| | |
|---|---|
| Col. 2, line 30 | Change "shownin" to --shown in-- |
| Col. 2, line 65 | Change "infrafrd" to --infrared-- |
| Col. 2, line 65 | Change "emmissions" to --emissions-- |
| Col. 3, line 44 | Change "uper" to --upper-- |

Signed and Sealed this

Thirtieth Day of December, 1986

*Attest:*

DONALD J. QUIGG

*Attesting Officer*

*Commissioner of Patents and Trademarks*